US006857929B2

(12) United States Patent
Liao et al.

(10) Patent No.: US 6,857,929 B2
(45) Date of Patent: Feb. 22, 2005

(54) ORNAMENTAL WATER BALL SHOWING TWO DYNAMIC VIEWS

(75) Inventors: Kuo-Yun Liao, Miao Li Hsien (TW); Chih-Chan Chang, 2F, No. 2, Alley 69, Lane 280, Sec. 6, Min Chuan E. Rd., Taipei 114 (TW)

(73) Assignee: Chih-Chan Chang, Taipei (TW)

( * ) Notice: Subject to any disclaimer, the term of this patent is extended or adjusted under 35 U.S.C. 154(b) by 0 days.

(21) Appl. No.: 10/435,107

(22) Filed: May 12, 2003

(65) Prior Publication Data

US 2004/0229541 A1 Nov. 18, 2004

(51) Int. Cl.[7] ..... A63H 23/08; G09F 19/00
(52) U.S. Cl. ..... 446/267; 40/406; 40/426
(58) Field of Search ..... 40/426, 406, 409, 40/410; 446/267, 133, 129

(56) References Cited

U.S. PATENT DOCUMENTS 3,006,111 A 10/1961 Koch
4,757,986 A 7/1988 Hwang et al.
4,817,311 A * 4/1989 Ong S. T. ..... 40/410
4,852,283 A * 8/1989 Teng ..... 40/426
5,092,065 A * 3/1992 Teng ..... 40/410
5,666,750 A * 9/1997 Segan et al. ..... 40/410
5,675,921 A * 10/1997 Lin ..... 40/409
5,732,492 A * 3/1998 Lin ..... 40/410
5,864,976 A * 2/1999 Yang ..... 40/410
6,132,284 A 10/2000 Lin
6,174,215 B1 * 1/2001 Shih ..... 446/265
6,374,522 B1 * 4/2002 Lo ..... 40/410
6,675,513 B2 * 1/2004 Liao ..... 40/426
2002/0020089 A1 * 2/2002 Yuen
2002/0189142 A1 * 12/2002 Hermanson et al.
2003/0140533 A1 * 7/2003 Liang
2003/0196357 A1 * 10/2003 Knapp et al.
2004/0045198 A1 * 3/2004 Lin

* cited by examiner

*Primary Examiner*—Jacob K. Ackun
*Assistant Examiner*—Faye Francis
(74) *Attorney, Agent, or Firm*—Troxell Law Office PLLC

(57) ABSTRACT

An ornamental water ball is provided in a base with a musical box having a movement and a lower disc, and in a transparent shell fixed to a top of the base with a fan and a decorated upper disc above the fan. When the movement is rotated, it synchronously rotates the upper disc through meshing of a first small gear on the movement with a second large gear mounted on an axis that is located in the base and engaged with a spindle of the upper disc. The lower disc is mounted on the axis and quickly rotated through meshing of a second small gear formed at a lower center of the lower disc with a first large gear mounted on the movement, so as to magnetically rotate the fan, causing the fan to scatter a plurality of snowflake-shaped chips or metallic chips in the shell.

10 Claims, 5 Drawing Sheets

ORNAMENTAL WATER BALL SHOWING TWO DYNAMIC VIEWS

FIELD OF THE INVENTION

The present invention relates to an ornamental water ball, and more particularly to an ornamental water ball showing two dynamic views at the same time.

BACKGROUND OF THE INVENTION

Ornamental water balls have been introduced into markets for many years. Most of the currently commercially available ornamental water balls internally include one single ornament that shows only one motion, such as scattering metallic chips in the water ball. Ornamental water balls disclosed in U.S. Pat. Nos. 3,006,111, 4,757,986, and 6,132,284 include a musical box mounted in a base of the water ball and having a movement that rotates to drive a first magnet to rotate at the same time, so that a second magnet provided below an ornament in the water ball is caused to move and bring the ornament to show one and only one motion.

It is therefore tried by the inventor to develop an ornamental water ball that shows two dynamic views at the same time and is therefore unique, novel, and more interesting for use.

SUMMARY OF THE INVENTION

A primary object of the present invention is to provide an ornamental water ball showing two dynamic views through rotating an ornament in the water ball by 360 degrees and scattering snowflake-shaped chips or metallic chips in the water ball at the same time.

To achieve the above and other objects, the ornamental water ball of the present invention is provided in a base with a musical box having a rotatable movement, and a lower disc mounted on an axis, and in a transparent shell fixed to a top of the base with a decorated upper disc and a fan below the upper disc. When the movement of the musical box is rotated, it synchronously rotates the decorated upper disc through meshing of a first small gear fixedly mounted on the movement with a second large gear mounted on the axis that is engaged with a spindle of the upper disc, so that a first dynamic view in the water ball is produced. The lower disc mounted on the axis is quickly rotated through meshing of a second small gear formed at a lower center of the lower disc with a first large gear mounted on the movement, so as to magnetically rotate the fan in the shell, causing the fan to scatter a plurality of snowflake-shaped chips or metallic chips in the shell and thereby produces a second dynamic view in the water ball when the upper disc rotates.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
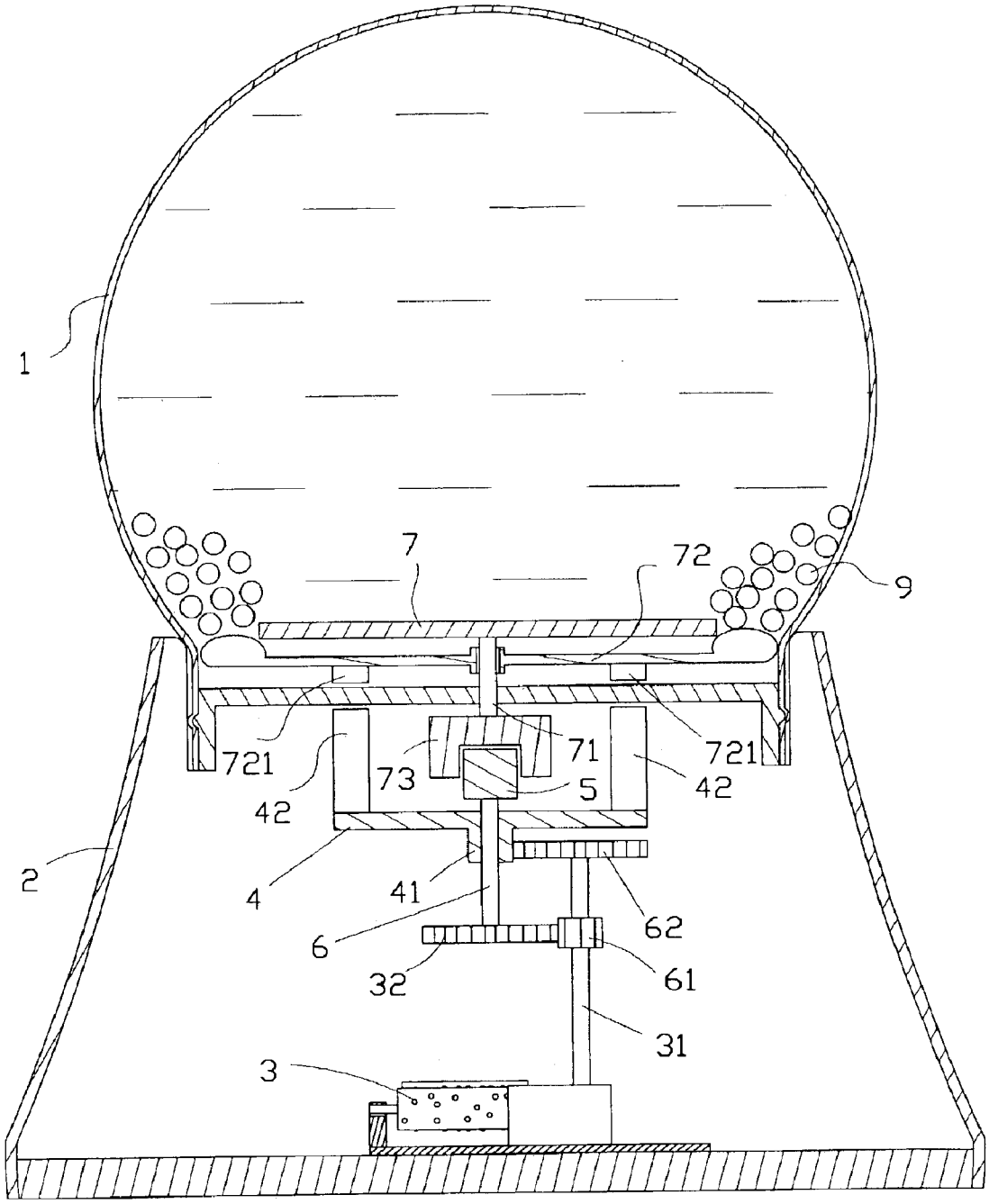
FIG. 1 is a vertical sectional view of an ornamental water ball according to an embodiment of the present invention.

Please refer to FIG. 1 that is a vertical sectional view of an ornamental water ball according to an embodiment of the present invention. As shown, the ornamental water ball mainly includes a transparent shell 1 for containing a desired type of liquid therein, and a base 2, to a top of which the shell 1 is firmly fixed.

A musical box 3 is mounted in the base 2 and can be actuated by means of a spring or other functionally equivalent members to rotate a movement 31 thereof. A first small gear 61 and a first large gear 62 located above the small gear 61 are vertically spaced on the movement 31. The first small gear 61 meshes with a second large gear 32 connected to a lower end of an axis 6. A lower disc 4 is rotatably mounted near an upper end of the axis 6, and has a second small gear 41 formed at a lower center thereof to mesh with the first large gear 62 as well as a plurality of first magnets 42 sequentially provided along a top periphery thereof. An engaging block 5 is fixedly connected to the upper end of the axis 6 to locate above the lower disc 4.

Figure 2:
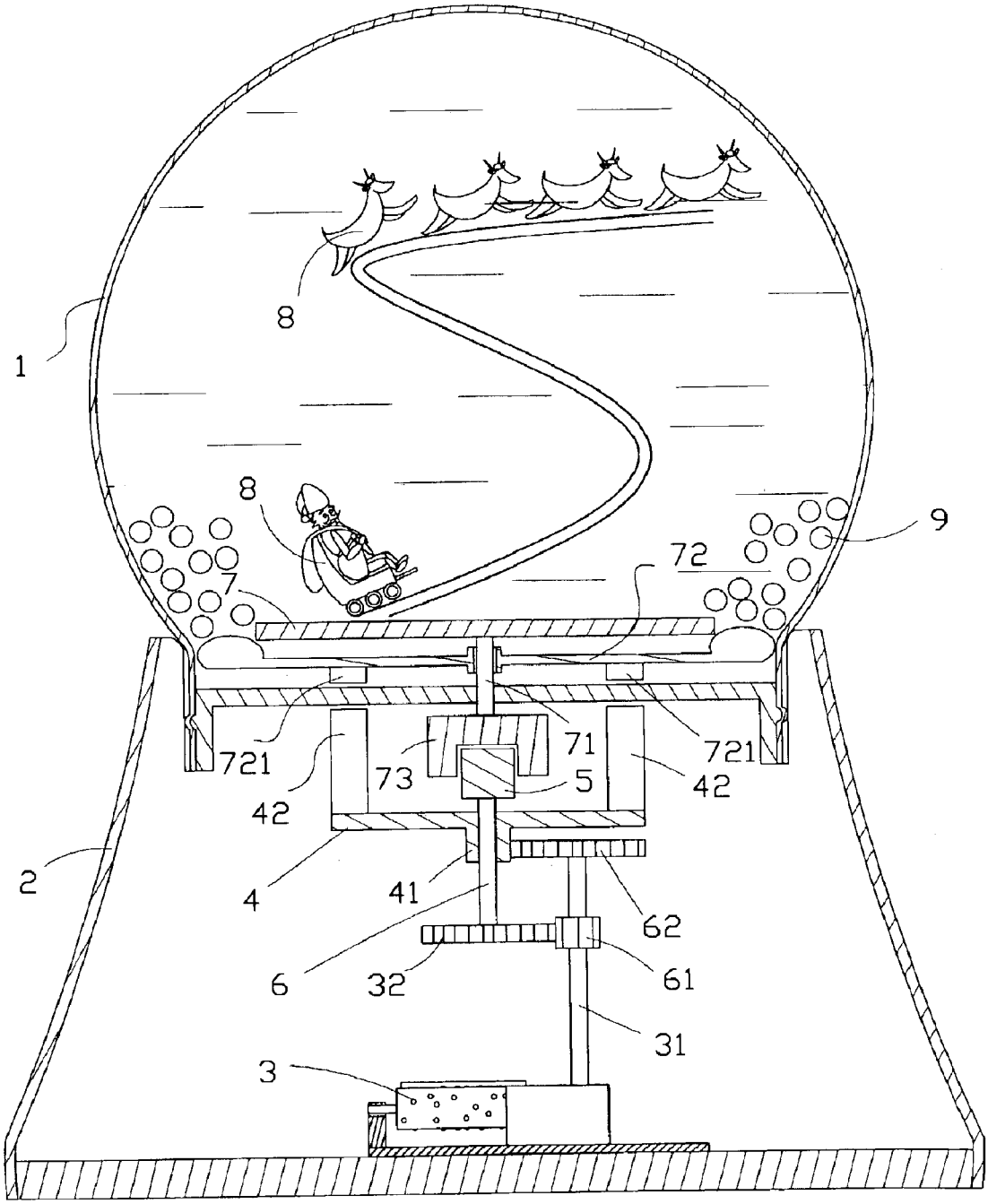
FIG. 2 is the ornamental water ball of FIG. 1 with a first ornament connected to a rotatable upper disc provided in the water ball.
Figure 3:
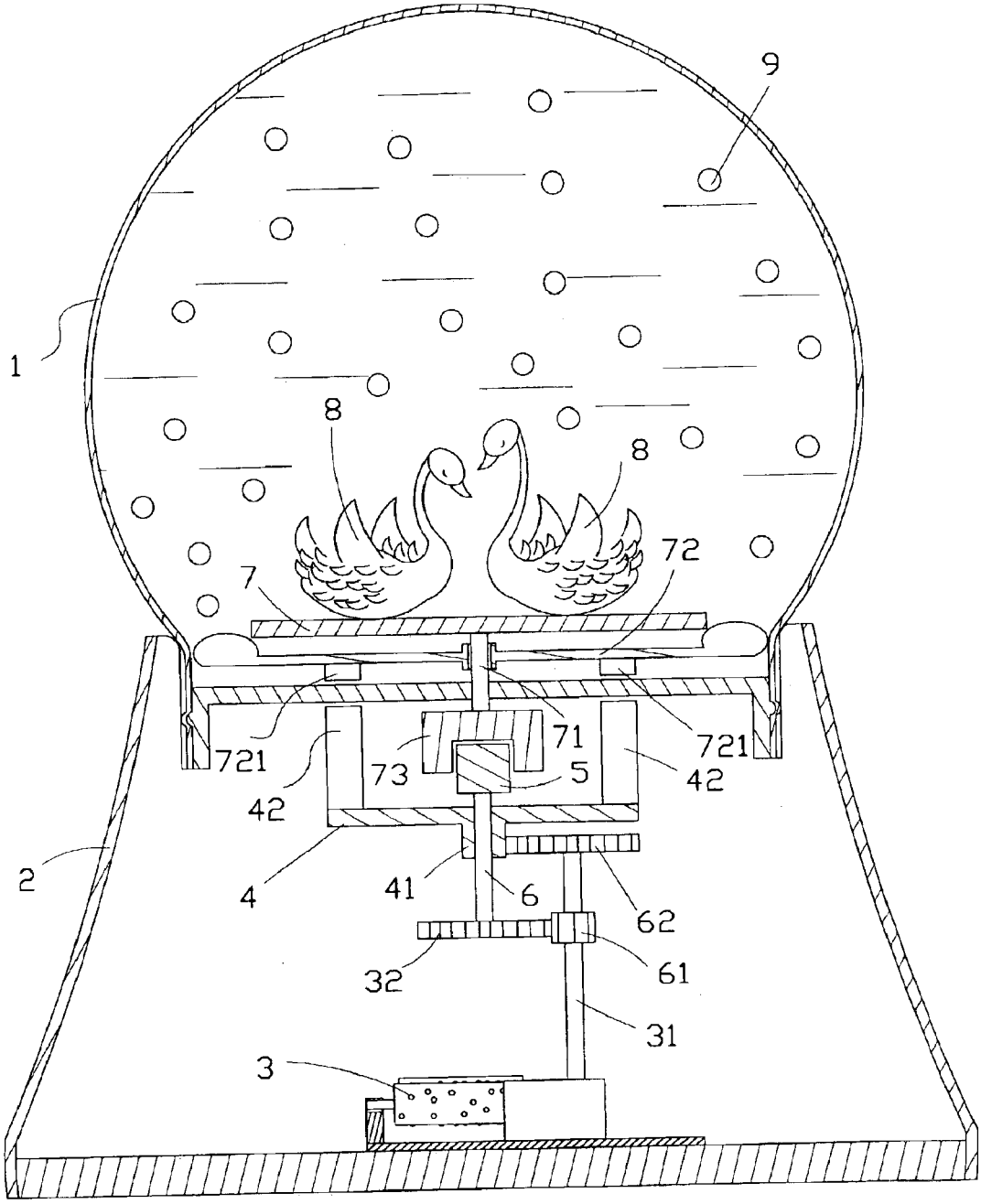
FIG. 3 is the ornamental water ball of FIG. 1 with a second ornament connected to the rotatable upper disc provided in the water ball.

In the transparent shell 1 of the ornamental water ball, there is provided an upper disc 7, a spindle 71 of which is downward extended into the base 2. A fan 72 is rotatably connected to the spindle 71 via a bearing to locate in the shell 1 below the upper disc 7. An engaging socket 73 is integrally connected to a lower end of the spindle 71 extended into the base 2, so as to rotate along with the spindle 71. The fan 72 is provided on an underside at positions corresponding to the first magnets 42 on the top periphery of the lower disc 4 with a plurality of second magnets 721. The second magnets 721 have a polarity different from that of the first magnets 42. As shown in FIGS. 2 and 3, one or more different ornaments 8, such as different persons, scenes, vehicles, including automobiles, airplanes, and vessels, and/or animals, maybe provided on the upper disc 7. Meanwhile, one or more types of light particles 9, such as snowflake-shaped chips, metallic chips, luminous chips, etc., may be positioned in the transparent shell 1 of the water ball to serve as decorative means to make the ornaments 8 more interesting for viewing.

Figure 4:
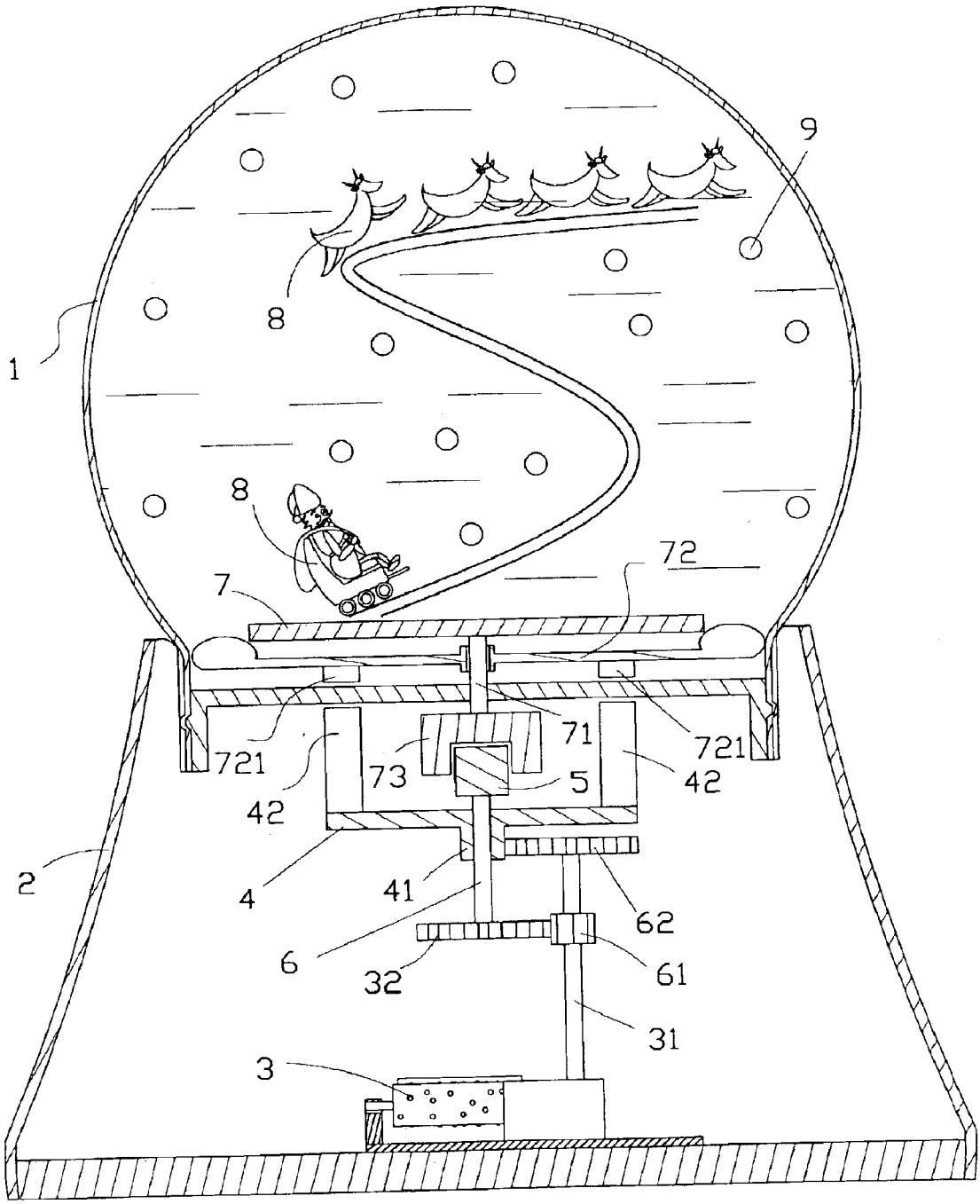
FIGS. 4 and 5 show the first ornament connected to the rotatable upper disc and a plurality of chips representing snowflakes in the water ball of the present invention are rotated and scattered, respectively.
Figure 5:
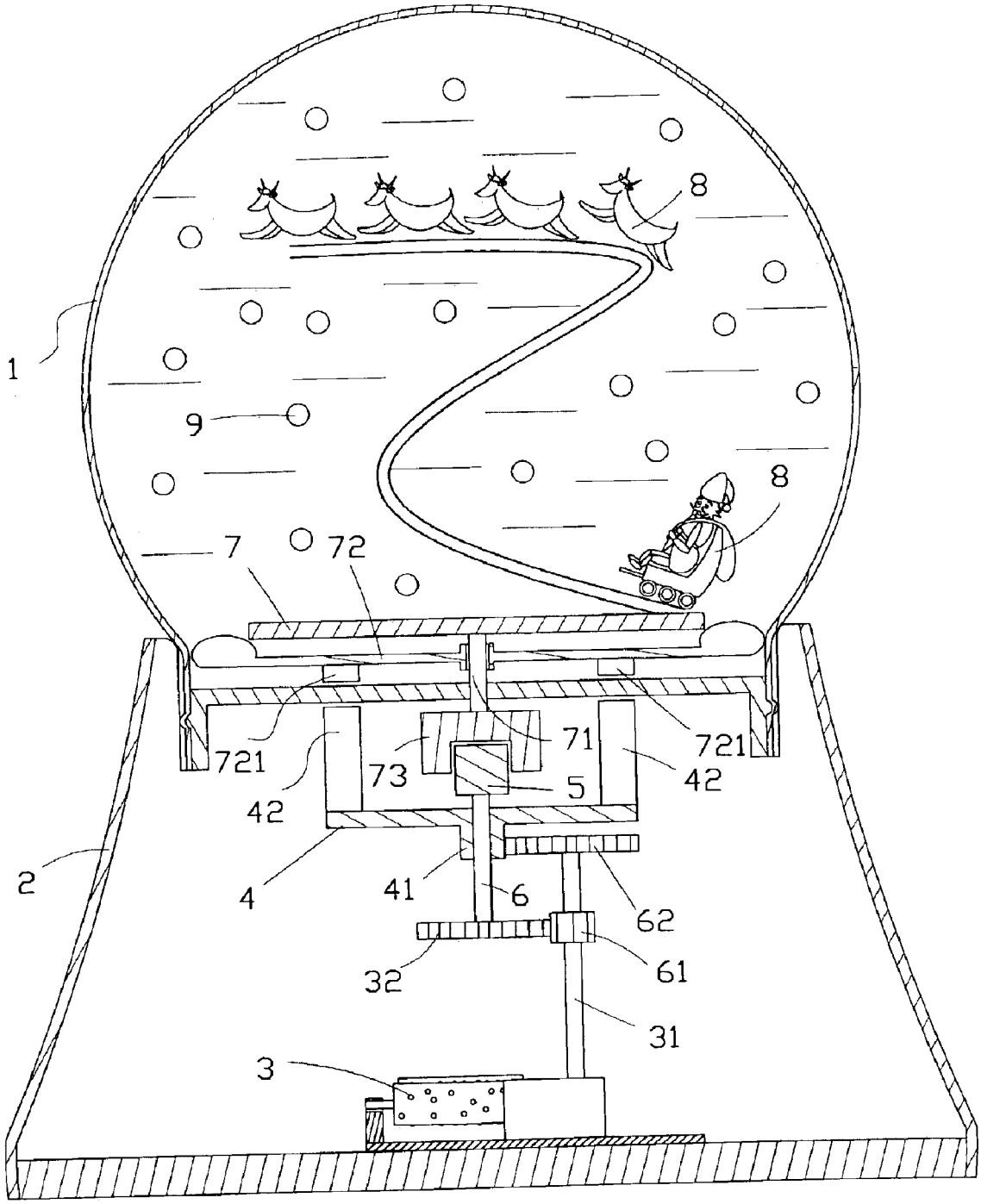

Please refer to FIGS. 4 and 5. When the movement 31 of the musical box 3 mounted in the base 2 below the transparent shell 1 is actuated and accordingly rotates, the first small and large gears 61, 62 fixed on the movement 31 rotate at the same time and respectively bring the axis 6 and the lower disc 4 to turn via meshing with the second large and small gears 32, 41, respectively. While the axis 6 rotates, the upper disc 7 in the transparent shell 1 rotates synchronously through engagement of the engaging block 5 fixedly connected to the top of the axis 6 with the engaging socket 73 fixedly connected to the lower end of the spindle 71 of the upper disc 7. The upper disc 7 in rotating in turn brings the ornament 8 provided thereon to move along with it in circular motion, forming a first dynamic view in the waterball. On the other hand, the lower disc 4 freely rotates at high speed due to meshing of the second small gear 41 with the first large gear 62, bringing the first magnets 42 mounted on the top of the lower disc 4 to move along with the disc 4 in high-speed circular motion. The first magnets 42 moving in high-speed circular motion magnetically attract the second magnets 721 mounted to the underside of the fan 72 for the latter to synchronously rotate at high speed and thereby scatters the snowflake-shaped chips 9, metallic chips, or luminous chips in the transparent shell 1. When the scattered snowflake-shaped chips 9 or the like slowly fall, they together form another dynamic view in the water ball.

What is claimed is:

1. An ornamental water ball showing two dynamic views, comprising a base, a transparent shell fixed to a top of said base for containing a liquid, a musical box mounted in said base and having a rotatable movement, a lower disc located in said base, an upper disc and a fan located in said transparent shell, and first and second sets of small and large gears located in said base and adapted to cause rotation said lower disc, said upper disc, and said fan at the same time when said movement of said musical box is actuated to rotate, wherein said first set of small and large gears are fixedly mounted on said movement of said musical box, wherein said first small gear meshes with said second large gear, which is connected to an axis in said base, wherein said axis is fixedly connected to a lower end to said second large gear, and at an upper end to an engaging block, and movably connected near said upper end to said lower disc, wherein said second small gear is formed at a lower center of said lower disc.

2. The ornamental water ball showing two dynamic views as claimed in claim 1, wherein said second small gear below said lower disc meshes with said first large gear on said movement of said musical box.

3. The ornamental water ball showing two dynamic views as claimed in claim 1, wherein said lower disc is provided along a top periphery with a plurality of spaced first magnets.

4. The ornamental water ball showing two dynamic views as claimed in claim 1, wherein said upper disc in said transparent shell has a spindle downward extended into said base, said spindle being provided at a lower end with an engaging socket, and said fan being rotatably connected, to said spindle to locate below said upper disc.

5. The ornamental water ball showing two dynamic views as claimed in claim 4, wherein said fan is connected to said spindle of said upper disc via a bearing.

6. The ornamental water ball showing two dynamic views of claimed in claim 4, wherein said engaging socket is fixedly connected to the lower end of said spindle of said upper disc.

7. The ornamental water ball showing two dynamic views as claimed in claim 4, wherein said upper disc is provided on a top thereof with one or more ornaments to move along with said upper disc in circular motion.

8. The ornamental water ball showing two dynamic views as claimed in claim 1, wherein said transparent shell is internally provided with a plurality of chips selected from a group consisting of snowflake-shaped chips, metallic chips, and luminous chips that are light in weight.

9. An ornamental water ball showing two dynamic views, comprising a base, a transparent shell fixed to a top of said base for containing a liquid, a musical box mounted in said base and having a rotatable movement, a lower disc located in said base, an upper disc and a fan located in said transparent shell, and first and second sets of small and large gears located in said base and adapted to cause rotation said lower disc, said upper disc, and said fan at the same time when said movement of said musical box is actuated to rotate, wherein said upper disc in said transparent shell has a spindle downward extended into said base, said spindle being provided at a lower end with an engaging socket, and said fan being rotatable connected to said spindle to locate below said upper disc, wherein said engaging socket is fixedly connected to the lower end of said spindle of said upper disc, wherein said engaging socket is engaged with said engaging block fixedly connected to an upper end of an axis in said base.

10. An ornamental water ball showing two dynamic views, comprising a base, a transparent shell fixed to a top of said base for containing a desired type of liquid, a musical box mounted in said base and having a rotatable movement, a lower disc located in said base, an upper disc and a fan located in said transparent shell, and first and second sets of small and large gears located in said base and adapted to cause rotation said lower disc, said upper disc, and said fan at the same time when said movement of said musical box is actuated to rotate, wherein said upper disc in said transparent shell has a spindle downward extended into said base, said spindle being provided at a lower end with an engaging socket, and said fan being rotatably connected to said spindle to locate below said upper disc, wherein said fan is provided on an underside with a plurality of second magnets corresponding to a plurality of first magnets on said lower disc.

* * * * *